US006763709B1

(12) United States Patent
Haggett et al.

(10) Patent No.: US 6,763,709 B1
(45) Date of Patent: Jul. 20, 2004

(54) VEHICLE

(75) Inventors: Martin Roy Haggett, Rugby (GB); William Richard Hutchins, Kenilworth (GB); Michael Krauss, München (DE)

(73) Assignees: Bayerische Motoren Werke Aktiengesellschaft, Munich (DE); Land Rover, Lighthorne (GB)

( * ) Notice: Subject to any disclaimer, the term of this patent is extended or adjusted under 35 U.S.C. 154(b) by 0 days.

(21) Appl. No.: 09/936,977

(22) PCT Filed: Mar. 10, 2000

(86) PCT No.: PCT/GB00/00905

§ 371 (c)(1),
(2), (4) Date: Sep. 28, 2001

(87) PCT Pub. No.: WO00/57043

PCT Pub. Date: Sep. 28, 2000

(30) Foreign Application Priority Data

Mar. 20, 1999 (GB) ..... 9906402

(51) Int. Cl.[7] ..... G01M 19/00
(52) U.S. Cl. ..... 73/118.1
(58) Field of Search ..... 73/118.1, 117.3

(56) References Cited

U.S. PATENT DOCUMENTS

| | | | | |
|---|---|---|---|---|
| 4,069,712 A | | 1/1978 | Armstrong et al. | |
| 4,702,620 A | | 10/1987 | Ford | |
| 5,215,044 A | | 6/1993 | Banzhaf et al. | |
| 5,526,871 A | * | 6/1996 | Musser et al. | 73/117.3 |
| 6,532,807 B1 | * | 3/2003 | Krauss | 73/118.1 |
| 2003/0131659 A1 | * | 7/2003 | Oka et al. | 73/118.1 |

FOREIGN PATENT DOCUMENTS

| | | |
|---|---|---|
| DE | 19728351 A | 1/1999 |
| EP | 0761940 A1 | 3/1997 |
| FR | 2673244 A | 8/1992 |
| FR | 2773845 A1 | 7/1999 |
| GB | 2290123 A | 12/1995 |

* cited by examiner

*Primary Examiner*—Edward Lefkowitz
*Assistant Examiner*—Maurice Stevens
(74) *Attorney, Agent, or Firm*—Davis & Bujold, P.L.L.C.

(57) ABSTRACT

A vehicle (10) is disclosed which includes a thermostat (22) in a bottom hose (24) of a radiator (16). An onboard diagnostic arrangement is provided to monitor the efficiency of the thermostat (22). Temperature sensors (S1, S2) are provided to monitor the temperature of the coolant across the radiator (16) so that a controller (40) can derive from those measurements the temperature differential across the thermostat (22). If the temperature $T_{eng}$ of the coolant at the thermostat inlet is below the thermostat opening temperature $T_{open}$ and the differential temperature between the thermostat inlet temperature $T_{eng}$ and the thermostat outlet temperature $T_{rad}$ is below a fault threshold $D_{tstat}$, the thermostat (22) is evaluated as being stuck open or leaking, which results in a fault being recorded and a malfunction indicator lamp (MIL) being illuminated.

17 Claims, 8 Drawing Sheets

FAULT DETECTION

FAULT DETECTION $OK_{test}$ SUBROUTINE $OK_{test}$ SUBROUTINE

| LABEL | TYPE OF LABEL | LABEL MEANING |
|---|---|---|
| | | |
| $OK_{test}$ | LOCAL VARIABLE | CONDITION FOR THERMOSTAT DIAGNOSIS MET? |
| INITIALISE | INPUT VARIABLE | CONDITION FOR DIAGNOSIS INITIALISATION MET? |
| IDLE | INPUT VARIABLE | IS ENGINE IDLING? |
| ORFCO | INPUT VARIABLE | IS ENGINE IN OVER-RUN FUEL CUT-OFF MODE? |
| NFF | OUTPUT VARIABLE | DIAGNOSIS COMPLETE AND NO FAULT FOUND. |
| FAULT | OUTPUT VARIABLE | FAULT CONDITION. |
| $E_{run}$ | INPUT VARIABLE | ENGINE RUNNING? (e.g. ABOVE A THRESHOLD OF 500RPM) |
| $E_{S1}$ | INPUT VARIABLE | ERROR FLAG FOR SENSOR S1 (ENGINE TEMPERATURE) |
| $E_{S2}$ | INPUT VARIABLE | ERROR FLAG FOR SENSOR S2 (RADIATOR OUTLET TEMPERATURE) |
| $E_{tstat}$ | INPUT VARIABLE | ERROR FLAG – THERMOSTAT STUCK OPEN OR LEAKING. |
| $T_{eng}$ | INPUT VARIABLE | ENGINE COOLANT TEMPERATURE. |
| $T_{rad}$ | INPUT VARIABLE | COOLANT TEMPERATURE IN THE REGION OF THE RADIATOR OUTLET. |
| CYCLE | OUTPUT VARIABLE | CYCLE FLAG, INDICATING THERMOSTAT DIAGNOSIS IS UNDERWAY. |
| $D_{tstat}$ | FIXED VALUE | FAULT THRESHOLD FOR THE DIFFERENCE BETWEEN $T_{eng}$ AND $T_{rad}$. |
| $TD_{test}$ | MAPPED VALUE | TIME DELAY FOR STARTING THERMOSTAT DIAGNOSIS. |
| $TD_{debounce}$ | FIXED VALUE | TIME DELAY (THERMOSTAT DEBOUNCE BEFORE STARTING DIAGNOSIS) |
| $T_{open}$ | FIXED VALUE | THERMOSTAT OPENING TEMPERATURE |

*Fig. 6*

VEHICLE

FIELD OF THE INVENTION

This invention relates to vehicles and in particular to a vehicle which has a cooling circuit including a thermostat.

It is a known problem that a thermostat in a vehicle cooling system can leak or become stuck in an open or closed position. It is desirable to monitor the operational efficiency of such thermostats because their failure can lead to reduced efficiency in some emissions related monitoring and control operations. For example, it is sometimes necessary for the coolant to reach a predetermined temperature before an on-board diagnostic operation can be carried out on a fuelling system or on an exhaust gas oxygen sensor. In one known case this temperature, (in the order of 80° C.), may not be reached if the thermostat is stuck open or leaking. It is, therefore, desirable to detect such a faulty thermostat so that the fault can be indicated to a user or maintainer and the problem rectified.

RELATED ART

The use of a test apparatus to check cooling system operation under workshop conditions is known, e.g. from U.S. Pat. No. 4,069,712, U.S. Pat. No. 4,702,620 and U.S. Pat. No. 5,526,871. The use of these known systems does not allow the vehicle itself to perform an on-board diagnostic routine to test thermostat efficiency.

One attempt to provide on-board diagnostic capability of thermostat operation is disclosed in FR 2773845, in which the actual temperature of the cooling water is compared with a calculated model of anticipated cooling water temperature.

It is an object of this invention to provide an improved vehicle.

SUMMARY OF THE INVENTION

Accordingly, the invention provides a vehicle comprising a cooling circuit including a thermostat arranged in use to control the flow of a coolant around at least a part of the cooling circuit, the vehicle further comprising a control means arranged in use to carry out an on-board fault detection test routine to establish the operational condition of the thermostat, the test routine being arranged to determine the condition of the thermostat from a comparison between a thermostat inlet temperature and a thermostat outlet temperature and to determine that the thermostat is faulty if the thermostat inlet temperature is below an opening temperature of the thermostat and there is a temperature differential between the thermostat inlet temperature and the thermostat outlet temperature which differential is below a predetermined fault threshold, the cooling circuit further comprising a radiator and the thermostat being arranged in use to control the flow of the coolant through the radiator, characterised in that the thermostat inlet temperature is derived from a top hose or radiator inlet temperature and/or the thermostat outlet temperature is derived from a bottom hose or radiator outlet temperature.

The test routine may be arranged to evaluate a said fault condition as a leaking or substantially stuck open thermostat.

The control means may be provided with a signal indicative of the thermostat outlet temperature from an outlet temperature sensing means positioned in the region of a bottom tank or outlet hose of the radiator.

The control means may be arranged to perform a diagnostic test on the outlet temperature sensing means and to test the condition of the thermostat only if there is no fault condition detected with said outlet temperature sensing means.

The control means may be provided with a signal indicative of the thermostat inlet temperature from an inlet temperature sensing means positioned in the region of a top tank or inlet hose of the radiator or positioned so as to sense engine block temperature or engine block coolant temperature.

The control means may be arranged to perform a diagnostic test on the inlet temperature sensing means and to test the condition of the thermostat only if there is no fault condition detected with said inlet temperature sensing means.

The control means may be arranged not to test the condition of the thermostat if the engine is running at an idle speed and may be arranged not to test the condition of the thermostat if the engine is operating in an over-run-fuel-cut-off mode. The control means may be arranged to test the condition of the thermostat only if the engine has been running for a predetermined period of time.

The control means may be arranged to record the detection of a fault with the thermostat, the fault condition being recorded in a retrievable manner which can be used so as to provide to a user or maintainer an indication that a fault with the thermostat has been recorded. Said indication may comprise the illumination of a malfunction indicator lamp (MIL) or an engine check light. The control means may be arranged to record a said fault with the thermostat only if said temperature differential remains present after a thermostat debounce delay.

The outlet temperature sensing means may be formed so as to act also as a drain plug for the radiator and the inlet temperature sensing means may comprise an engine temperature sensor.

Said fault threshold may be in the order of 30° C.

The invention also provides a method of establishing the operational condition of a thermostat included in a cooling circuit of a vehicle by performing an on-board fault detection test routine which includes comparing a thermostat inlet temperature and a thermostat outlet temperature and determining that the thermostat is faulty if the thermostat inlet temperature is below an opening temperature of the thermostat and there is a temperature differential between the thermostat inlet temperature and the thermostat outlet temperature which differential is below a predetermined fault threshold, characterised in that the method includes deriving the thermostat inlet temperature from a top-hose or radiator inlet temperature and/or deriving the thermostat outlet temperature from a bottom hose or radiator outlet temperature.

The method may include evaluating a said fault condition as a leaking or substantially stuck open thermostat.

BRIEF DESCRIPTION OF THE DRAWINGS

The invention will now be described by way of example with reference to the accompanying drawings, in which:

FIG. 6 is a table providing a key for the labels used in FIGS. 2 to 4;

DETAILED DESCRIPTION OF THE PREFERRED EMBODIMENT

Figure 1:
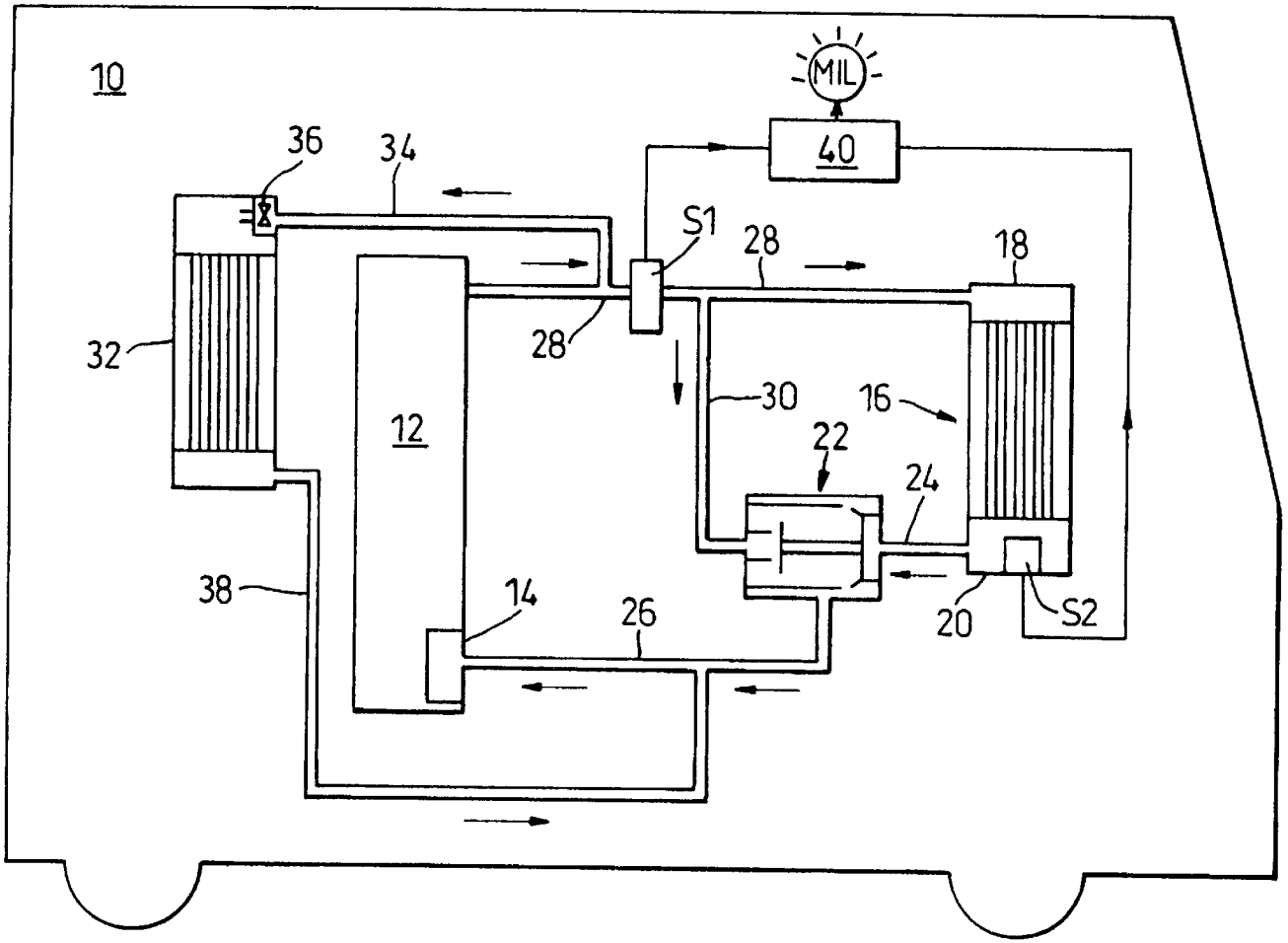
FIG. 1 is a schematic diagram of a vehicle according to a first embodiment of the invention.

Referring to FIGS. 1 to 7, a vehicle 10 comprises an engine 12 having a coolant circulation pump 14 and a cooling circuit which includes a radiator 16 having a top tank 18 and a bottom tank 20. A combined by-pass and thermostat assembly 22 is interposed in the supply line between the bottom tank 20 and the coolant circulation pump 14. The by-pass and thermostat assembly 22 used in this embodiment is substantially of the type disclosed in GB 2290123.

The thermostat 22 is an engine inlet thermostat (also known in the art as a bottom-hose thermostat) and is connected to the bottom tank 20 of the radiator 16 by means of a bottom hose 24 and to the circulation pump 14 by means of a supply hose 26. The thermostat 22 is further connected, by means of a by-pass hose 30, to a top or return hose 28 connecting the engine 12 to the top tank 18.

The feed for a heater assembly 32 is provided by a heater inlet hose 34 which is tapped off the top hose 28 and which includes a valve 36 to control the flow rate of coolant through the heater 32. The return for the heater assembly 32 is provided by a heater return hose 38 which is tapped into the supply hose 26.

A controller 40 is provided which is arranged in use to receive radiator inlet temperature signals (i.e. engine coolant temperature signals $T_{eng}$) from an inlet temperature sensing means in the form of an engine temperature sensor S1 which is positioned in the top hose 28. The engine temperature sensor S1 could instead be arranged to monitor engine block temperature or the temperature of coolant circulating in the engine 12, the important factor being that the controller 40 obtains a signal from which it 40 can derive a good indication of the radiator inlet temperature and therefore also of the thermostat inlet temperature.

The controller 40 is also arranged in use to receive radiator outlet temperature signals from a radiator outlet temperature sensor S2, which is positioned in the bottom tank 20 and is further arranged to act as the drain plug for the radiator 16. The radiator outlet temperature signal $T_{rad}$ is indicative of the temperature of coolant coming out of the radiator 16 after cooling and is therefore a good indication of the temperature of coolant on the outlet side of the thermostat 22.

In use, when the engine 12 is cold (i.e. $T_{eng}<T_{statopen}$) the thermostat part of the assembly 22 is in a closed position preventing the passage of coolant from the bottom tank 20 into the engine 12 via the bottom hose 24 and the supply hose 26.

To prevent local overheating of the engine 12 when the thermostat valve is closed, the by-pass valve part of the assembly 22 is opened to allow a controlled flow of coolant to pass from the top hose 28 through the by-pass hose 30 to the supply hose 26.

As the temperature of the coolant approaches the normal engine running temperature, the by-pass valve part of the assembly 22 closes so that flow through the by-pass hose 30 is effectively shut off, thus ensuring that virtually all of the coolant circulates through the radiator 16 before returning to the engine 12 .

When the temperature of the coolant passing through the thermostat by-pass reaches the thermostat opening temperature $T_{statopen}$, the thermostat part of the assembly 22 opens gradually to allow a progressively increasing flow of coolant to be admitted from the bottom tank 20 through the bottom hose 24 to mix with the coolant already circulating through the engine 12.

The thermostat opening temperature $T_{statopen}$ for this type of arrangement is not fixed at a single temperature, i.e. the nominal opening temperature of the thermostat. The opening temperature is instead a variable (nominally about 86° C.) which is inversely dependent on the temperature of the coolant leaving the radiator 16. This is advantageous because the thermostat 22 can take account of local variations in ambient temperature, as is described in greater detail in GB 2290123.

The controller 40 is arranged to detect a leaking or stuck open thermostat assembly, i.e. one which lets coolant through when it is supposed to be shut. A thermostat fault detection routine is initialised each time the engine 12 is started from a cold start condition.

Figure 2:
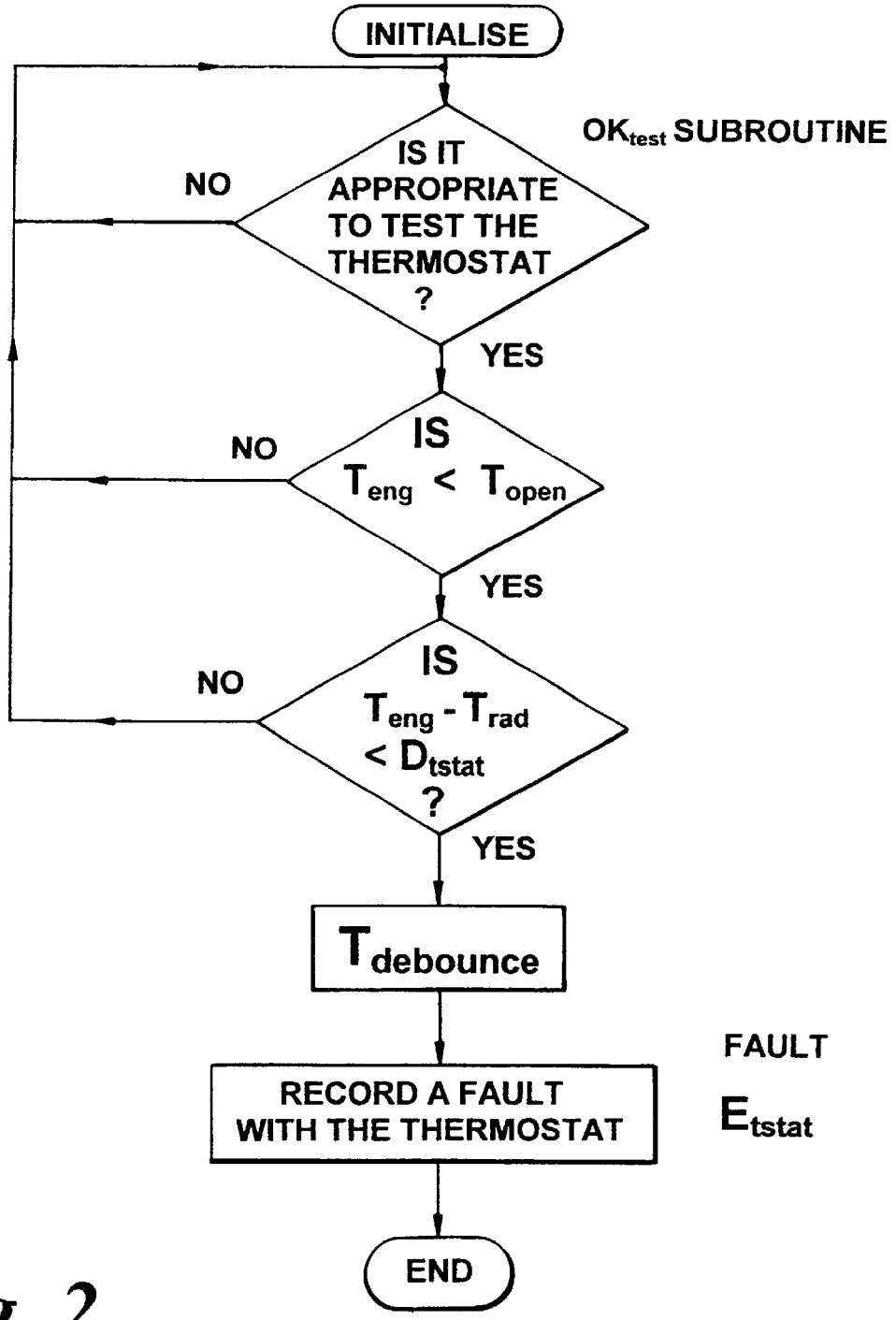
FIG. 2 is a flow chart of a control process of the vehicle of FIG. 1.
Figure 3:
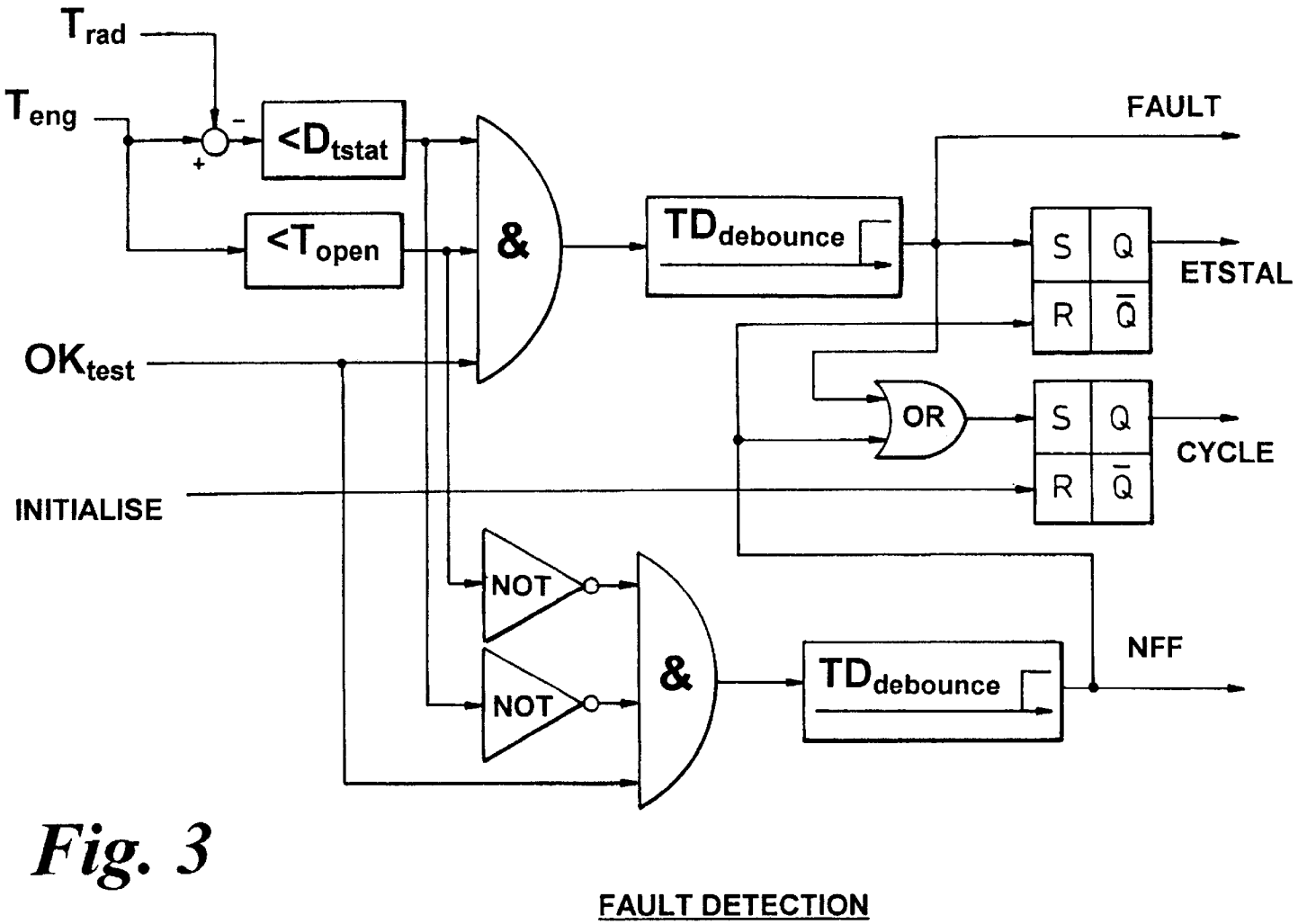
FIG. 3 is a logic diagram for the flow chart of FIG. 2.
Figure 4:
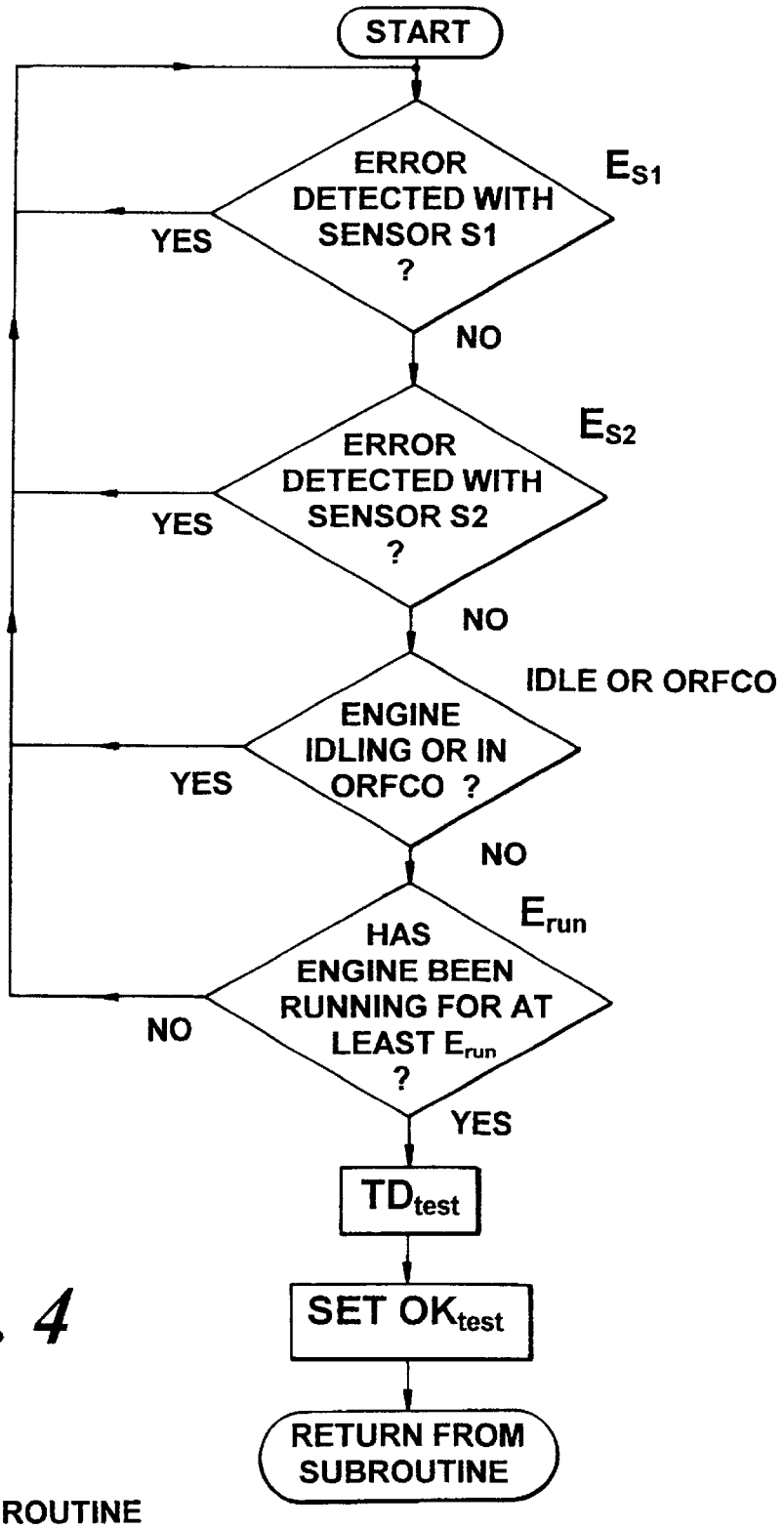
FIG. 4 is a flow chart of a subroutine of the control process of FIG. 2.
Figure 5:
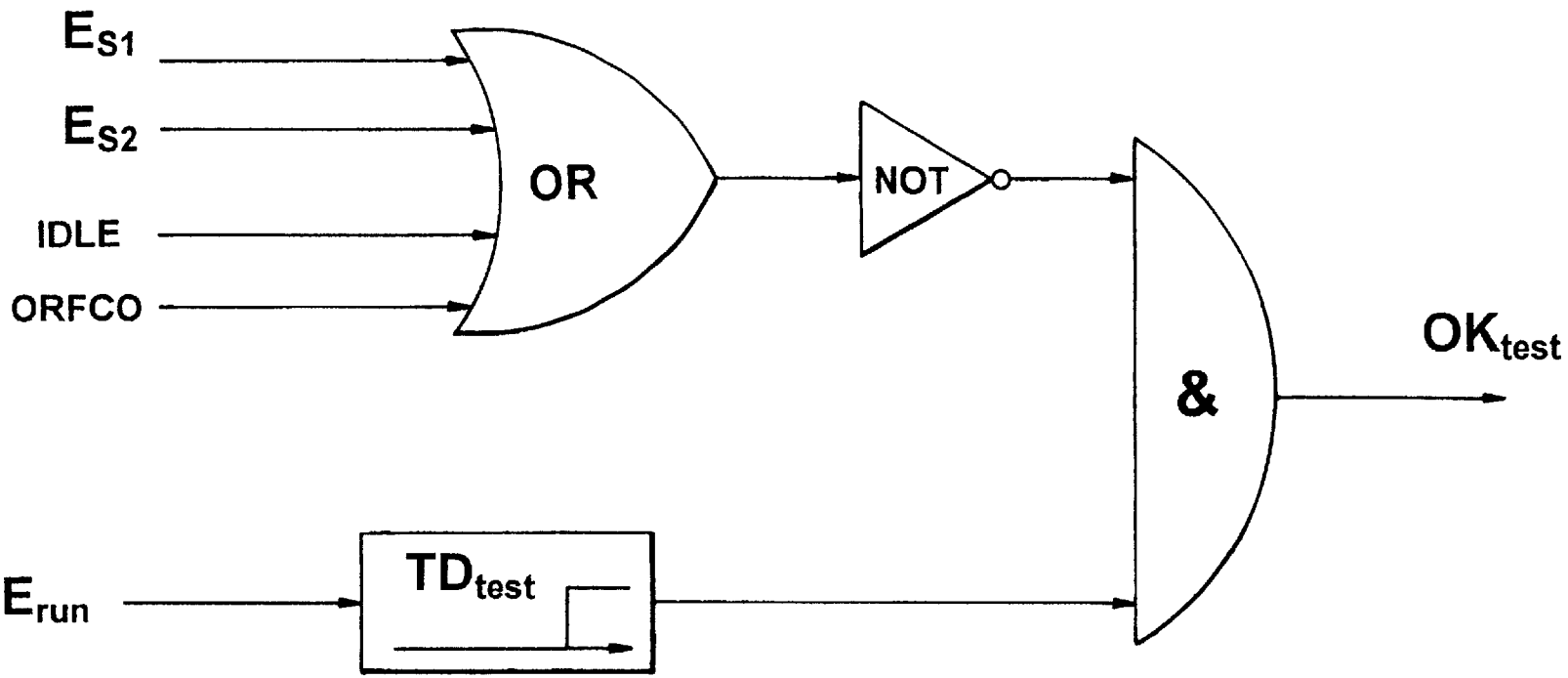
FIG. 5 is a logic diagram of the flow chart of FIG. 4.

The fault detection routine, as shown with particular reference to FIGS. 2 and 3, is only performed if the controller determines that it is appropriate to test the thermostat assembly 22. The decision on whether or not to test the thermostat 22 is made after each initialisation by performing an $OK_{test}$ subroutine, (shown with particular reference to FIGS. 4 and 5).

In the $OK_{test}$ subroutine, the temperature sensors S1, S2 are first tested, e.g. for open- or short-circuit faults. If either one S1, S2 is faulty, then it is not possible to carry out the thermostat fault detection routine and the sensor fault itself is logged for later rectification during vehicle servicing.

If the engine 12 is idling or in an over-run-fuel-cut-off mode (ORFCO), the fault detection routine cannot be carried out and the controller 40 waits. This is because of variations which can occur under these two conditions, although it may be possible to dispense with this check by thorough calibration of the effects of idling and over-run-fuel-cut-off.

The fault detection routine is also not carried out until the engine 12 has been running above a preset engine speed (e.g. 500 rpm) for a predetermined period $TD_{test}$ following engine starting. This delay $TD_{test}$ is a mapped value held in a memory of the controller 40 and is dependent on, for example, the characteristics of the temperature sensors S1, S2, type of temperature sensor S1, S2 used or factors affected by the installation site. The delay $TD_{test}$ may, for example, be in the region of 5 minutes.

If the conditions stipulated in the $OK_{test}$ subroutine are satisfied for the length of the delay period $TD_{test}$, the $OK_{test}$ flag is set in the controller 40 and the rest of the fault detection routine is carried out.

The temperature of the coolant coming out of the engine $T_{eng}$, as sensed by the engine temperature sensor S1, is treated by the controller 40 as the thermostat inlet temperature and if that temperature $T_{eng}$ has exceeded the thermostat opening temperature $T_{open}$, the thermostat 22 is assumed to be open and the fault detection routine waits.

The temperature $T_{rad}$ of the coolant sensed by the bottom tank sensor S2 is treated by the controller 40 as the thermostat outlet temperature. If the thermostat inlet temperature $T_{eng}$ is below the thermostat opening temperature $T_{open}$ and the conditions in the $OK_{test}$ subroutine have been met, the controller 40 measures the temperature difference across the radiator 16, i.e. $T_{eng}-T_{rad}$, which is assumed to be the temperature differential across the thermostat 22.

If this temperature difference $T_{eng}-T_{rad}$ is below a predetermined level, defined by a fault threshold $D_{tstat}$, the controller 40 assumes that the thermostat 22 is leaking, but not until the expiry of a (tuneable) period of time $T_{debounce}$, e.g. 10 seconds, which gives the thermostat 22 a chance to settle down after initial engine running.

If a fault condition (leaking or stuck open thermostat 22) is found, an error flag $E_{tstat}$ is set in the controller 40 for later retrieval during a diagnostic or servicing procedure. A fault output (Fault) illuminates a malfunction indicator lamp (MIL), which is also referred to in the art as an engine check light.

To reduce the likelihood of false alarming, the error flag $E_{tstat}$ and the fault output (Fault) are only set if a fault condition is detected on two successive fault detection routine test cycles. A single fault condition may be reset by a subsequent return to normal operation. If the thermostat 22 is found to be operating correctly, a no-fault-found flag NFF is set on completion of the fault detection subroutine.

It can therefore be seen that a fault condition representing a leaking or stuck-open thermostat 22 is found if the pre-testing conditions are satisfied, the engine coolant temperature $T_{eng}$ is below the thermostat opening temperature $T_{open}$ and there is not a big enough temperature difference ($T_{eng}-T_{rad}<D_{tstat}$) across the thermostat 22.

Figure 7:
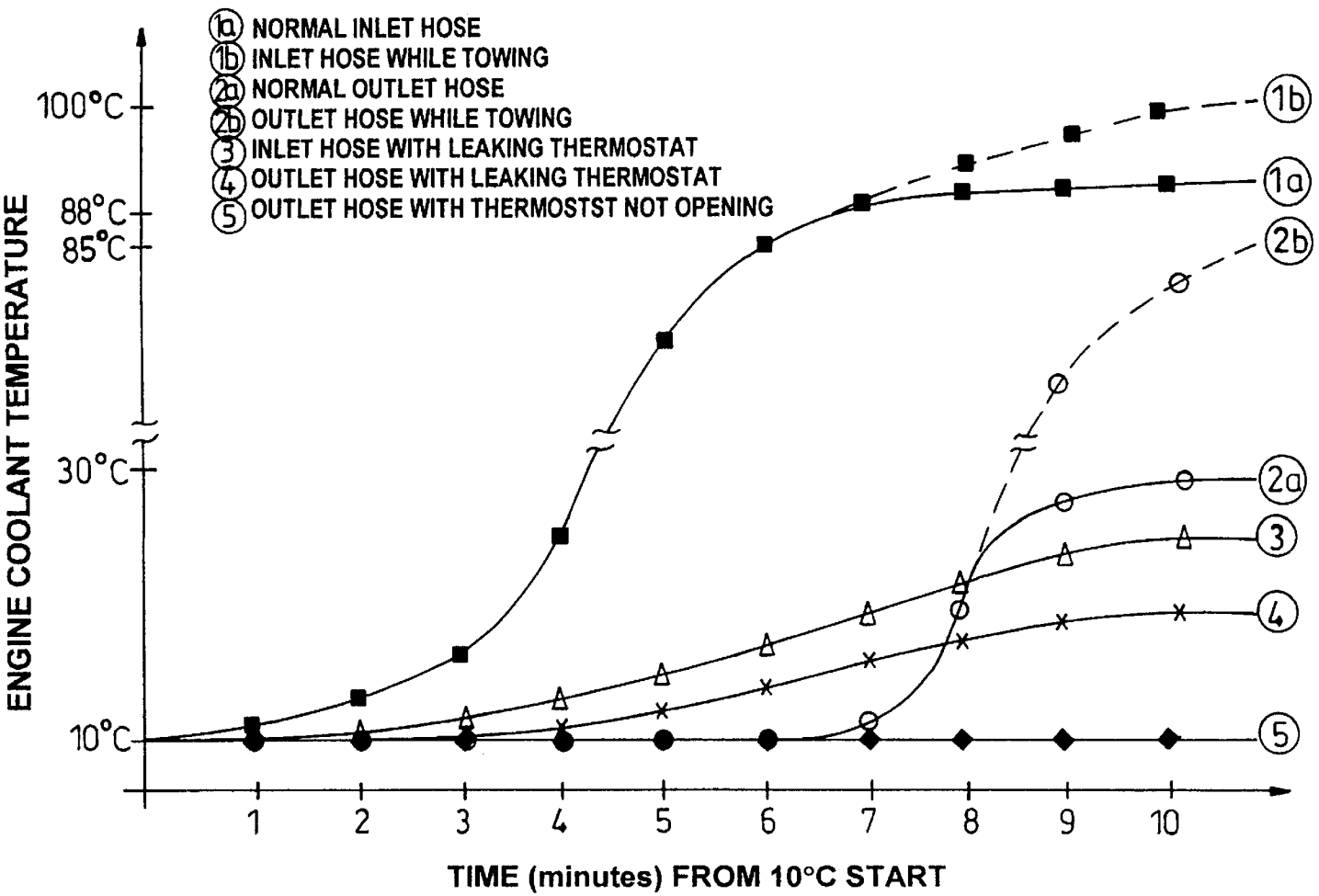
FIG. 7 is a graph showing various states of thermostat operation for a thermostat of the vehicle of FIG. 1.
Figure 8:
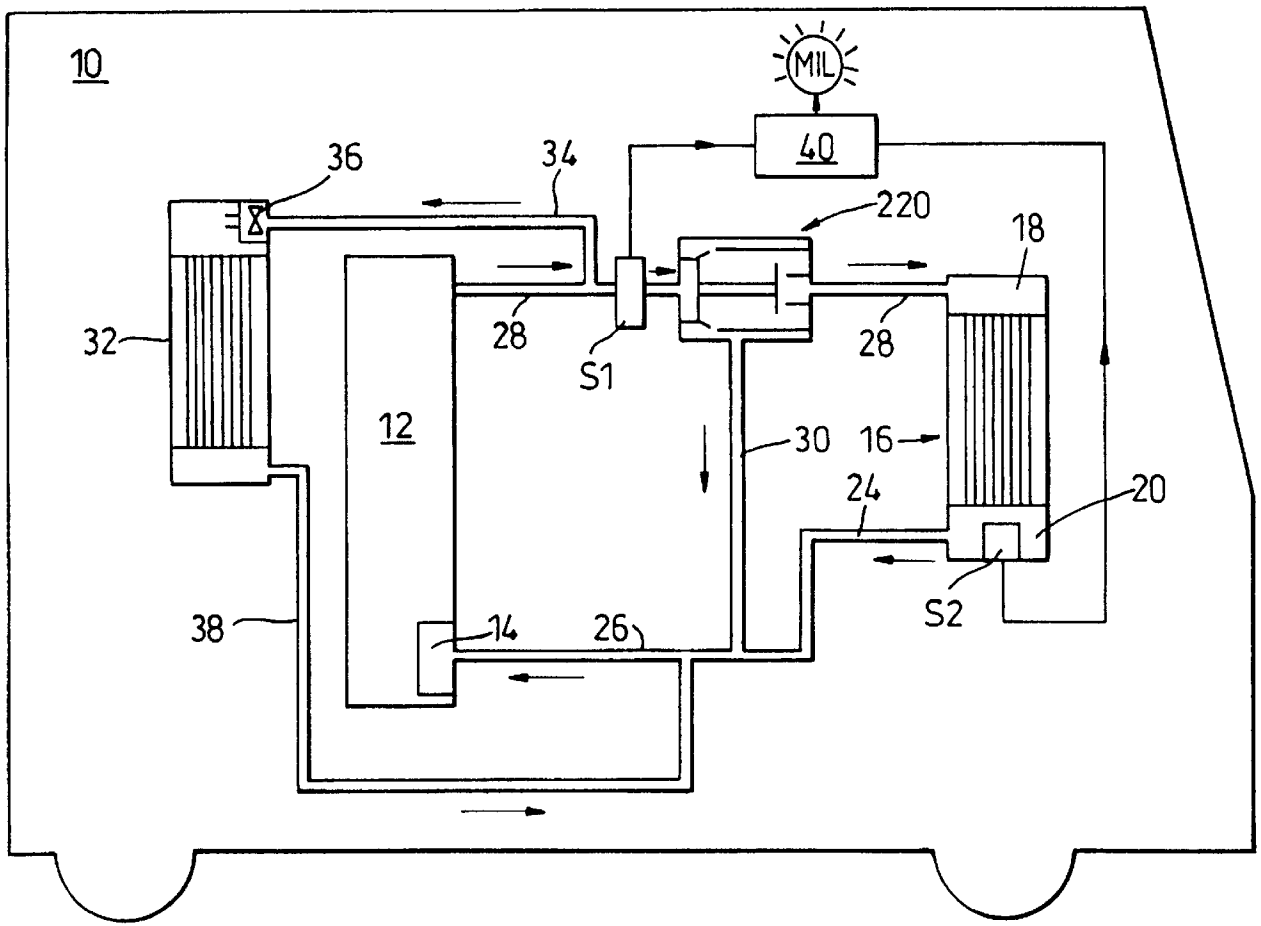
FIG. 8 is a schematic diagram of a vehicle according to a second embodiment of the invention.

As can be seen with particular reference to FIG. 7, which should be taken as only schematic in nature, it is difficult to place precise values on many of the variables in FIG. 6. When towing, for example, correction to the variables in necessary to over come the raised normal top and bottom hose temperatures, with similar considerations proving necessary while operating the vehicle 10 in high ambient temperatures. By way of example, however, it may be appropriate to set the fault threshold $D_{tstat}$ about 30° C., although it may prove necessary to vary this, e.g. when towing.

Referring now to FIGS. 2 to 8, in a second embodiment of the invention the bottom hose thermostat 22 has been replaced by a top-hose thermostat 220. Corresponding features carry corresponding reference numerals and the same considerations apply for thermostat fault detection as are applied in the first embodiment.

What is claimed is:

1. A vehicle comprising a cooling circuit including a thermostat arranged in use to control the flow of a coolant around at least a part of the cooling circuit, the vehicle further comprising a control means arranged in use to carry out an on-board fault detection test routine to establish the operational condition of the thermostat, the test routine being arranged to determine the condition of the thermostat from a comparison between a thermostat inlet temperature and a thermostat outlet temperature and to determine that the thermostat is faulty if the thermostat inlet temperature is below an opening temperature of the thermostat and there is a temperature differential between the thermostat inlet temperature and the thermostat outlet temperature which differential is below a predetermined fault threshold, the cooling circuit further comprising a radiator and the thermostat being arranged in use to control the flow of the coolant through the radiator, characterised in that the thermostat inlet temperature is derived from a top hose or radiator inlet temperature and/or the thermostat outlet temperature is derived from a bottom hose or radiator outlet temperature.

2. A vehicle according to claim 1, the test routine being arranged to evaluate a said fault condition as a leaking or substantially stuck open thermostat.

3. A vehicle according to claim 2, wherein the control means is provided with a signal indicative of the thermostat outlet temperature from an outlet temperature sensing means positioned in the region of a bottom tank or outlet hose of the radiator.

4. vehicle according to claim 3, wherein the control means is arranged to perform a diagnostic test on the outlet temperature sensing means and to test the condition of the thermostat only if there is no fault condition detected with said outlet temperature sensing means.

5. A vehicle according to claim 1, wherein the control means is provided with a signal indicative of the thermostat inlet temperature from an inlet temperature sensing means positioned in the region of a top tank or inlet hose of the radiator or positioned so as to sense engine block temperature or engine block coolant temperature.

6. A vehicle according to claim 5, wherein the inlet temperature sensing means comprises an engine temperature sensor.

7. A vehicle according to claim 1, wherein the control means is arranged not to test the condition of the thermostat if the engine is running at an idle speed.

8. A vehicle according to claim 1, wherein the control means is arranged not to test the condition of the thermostat if the engine is operating in an over-run-fuel-cutoff mode.

9. A vehicle according to claim 1, wherein the control means is arranged to test the condition of the thermostat only if the engine has been running for a predetermined period of time.

10. A vehicle according to claim 9, wherein the control means is arranged to perform a diagnostic test on the inlet temperature sensing means and to test the condition of the thermostat only if there is no fault condition detected with said inlet temperature sensing means.

11. A vehicle according to claim 10, said indication comprising the illumination of a malfunction indicator lamp (MIL) or an engine check light.

12. A vehicle according to claim 1, wherein the control means is arranged to record the detection of a fault with the thermostat, the fault condition being recorded in a retrievable manner which can be used so as to provide to a user or maintainer an indication that a fault with the thermostat has been recorded.

13. A vehicle according to claim 12, wherein the control means is arranged to record a said fault with the thermostat only if said temperature differential remains present after a thermostat debounce delay.

14. A vehicle according to claim 1, wherein the outlet temperature sensing means is formed so as to act also as a drain plug for the radiator.

15. A vehicle according to claim 1, wherein said fault threshold is in the order of 30° C.

16. A method of establishing the operational condition of a thermostat included in a cooling circuit of a vehicle by performing an on-board fault detection test routine which includes comparing a thermostat inlet temperature and a thermostat outlet temperature and determining that the thermostat is faulty if the thermostat inlet temperature is below an opening temperature of the thermostat and there is a temperature differential between the thermostat inlet temperature and the thermostat outlet temperature which differential is below a predetermined fault threshold, characterised in that the method includes deriving the thermostat inlet temperature from a top-hose or radiator inlet temperature and/or deriving the thermostat outlet temperature from a bottom hose or radiator outlet temperature.

17. A method according to claim 16, including evaluating a said fault condition as a leaking or substantially stuck open thermostat.

* * * * *